US006135426A

United States Patent [19]

Wargolet et al.

[11] Patent Number: 6,135,426

[45] Date of Patent: Oct. 24, 2000

[54] PRIMING SYSTEM FOR INTERNAL COMBUSTION ENGINES

[75] Inventors: Greg Wargolet, Sussex; Tim Buszkiewicz, Mequon; Paul Warren, Whitefish Bay, all of Wis.

[73] Assignee: Briggs and Stratton Corporation, Wis.

[21] Appl. No.: 09/003,968

[22] Filed: Jan. 7, 1998

[51] Int. Cl.[7] ..... F02M 1/16

[52] U.S. Cl. ..... 261/18.3; 123/576; 123/577; 261/34.1; 261/71; 261/DIG. 8

[58] Field of Search ..... 261/18.3, 34.1, 261/70, 71, DIG. 8; 123/576, 577

[56] References Cited

U.S. PATENT DOCUMENTS

| | | | |
|---|---|---|---|
| Re. 32,938 | 6/1989 | Haman et al. | 123/73 B |
| 923,093 | 5/1909 | Wegner . | |
| 1,030,931 | 7/1912 | Silver . | |
| 1,085,239 | 1/1914 | Bischof | 261/18.3 |
| 1,233,287 | 7/1917 | Costa | 261/18.3 |
| 1,237,490 | 8/1917 | Edens | 261/18.3 |
| 1,240,080 | 9/1917 | Morse et al. | 261/18.3 |
| 1,251,390 | 12/1917 | Lemp | 261/18.3 |
| 1,362,389 | 12/1920 | Brandon | 261/18.3 |
| 1,485,428 | 3/1924 | Patterson | 261/18.3 |
| 1,549,642 | 8/1925 | Wilbur | 123/576 |
| 1,570,143 | 1/1926 | Heide | 261/18.3 |
| 2,647,735 | 8/1953 | Haynie | 261/72 |
| 3,515,106 | 6/1970 | Verlinde | 123/127 |
| 3,783,841 | 1/1974 | Hirschler, Jr. et al. | 123/127 |
| 3,794,000 | 2/1974 | Hodkinson | 123/133 |

(List continued on next page.)

FOREIGN PATENT DOCUMENTS

| | | | |
|---|---|---|---|
| 0 036 608 A1 | 9/1981 | European Pat. Off. . | |
| 2142414 | 2/1973 | France . | |
| 2573817 | 5/1986 | France . | |
| 56-88938A | 7/1981 | Japan | 261/18.3 |
| 61-046455 | 3/1986 | Japan . | |
| 61-058962 | 3/1986 | Japan . | |
| 61-58962A | 3/1986 | Japan | 261/18.3 |
| 294245 | 7/1928 | United Kingdom | 261/18.3 |
| 646412 | 11/1950 | United Kingdom . | |
| 2081384 | 2/1982 | United Kingdom . | |

OTHER PUBLICATIONS

Shriram Honda Power Equipment Limited, *EBK 2000 A.C. Owner's Manual*, pp. 10–12, published at least as early as 1976.

Birla Yamaha Ltd., *LG 2000 Owner's Manual*, pp. 11–12, published at least as early as 1976.

Scientific American, *Practical Kerosene Carburetor*, pp. 48 and 52, Jul. 21, 1917.

Photograph of a Honda dual feed carburetor, first sold at least as early as 1976.

Photograph of a Yamaha dual feed carburetor, first sold at least as early as 1976.

*Primary Examiner*—Richard L. Chiesa

*Attorney, Agent, or Firm*—Michael Best & Friedrich LLP

[57] ABSTRACT

The priming system for a dual feed internal combustion engine provides a lighter, starting fuel to the venturi, the fuel nozzle, or to the carburetor bowl for engine starting. In a first embodiment, the starting or secondary fuel is mixed with the primary fuel in the fuel bowl, and the pure secondary fuel is provided to the fuel nozzle by actuation of a manually-operable primer. In a second embodiment, the secondary fuel is mixed with the primary fuel in the carburetor fuel bowl, and a shot of pure secondary fuel is provided directly to the carburetor venturi by the actuation of a manually-operable primer. In a third embodiment, a primer is manually operated before engine starting to remove primary fuel from the carburetor bowl and return it to the primary fuel tank. Thereafter, pure secondary fuel is provided directly to the carburetor bowl for engine starting through a changeover valve. After the engine has started, the changeover valve is positioned to permit primary fuel to be gravity fed to the carburetor bowl.

11 Claims, 4 Drawing Sheets

U.S. PATENT DOCUMENTS

| | | | |
|---|---|---|---|
| 3,807,377 | 4/1974 | Hirschler, Jr. et al. | 123/127 |
| 4,085,720 | 4/1978 | Etoh | 123/127 |
| 4,129,620 | 12/1978 | Etoh | 261/18 R |
| 4,375,795 | 3/1983 | Billingsley | 123/187.5 R |
| 4,394,331 | 7/1983 | Okabe et al. | 261/18 B |
| 4,395,998 | 8/1983 | Chou | 123/575 |
| 4,401,094 | 8/1983 | Shimmura et al. | 261/18.3 X |
| 4,437,448 | 3/1984 | Billingsley | 123/577 |
| 4,462,346 | 7/1984 | Haman et al. | 123/73 A |
| 4,462,944 | 7/1984 | Sprick | 123/577 X |
| 4,499,887 | 2/1985 | Billingsley et al. | 123/575 |
| 4,524,033 | 6/1985 | Elledge | 261/18 B |
| 4,572,133 | 2/1986 | Bago | 123/431 |
| 4,596,214 | 6/1986 | Yagi et al. | 123/260 |
| 4,646,691 | 3/1987 | Kiyota et al. | 123/179 G |
| 4,677,944 | 7/1987 | Nishimura et al. | 123/73 B |
| 5,031,590 | 7/1991 | Sakurai | 123/187.5 R |
| 5,119,775 | 6/1992 | Kokubo et al. | 123/179.16 |
| 5,181,488 | 1/1993 | Sakurai | 123/179.11 |

FIG. 1
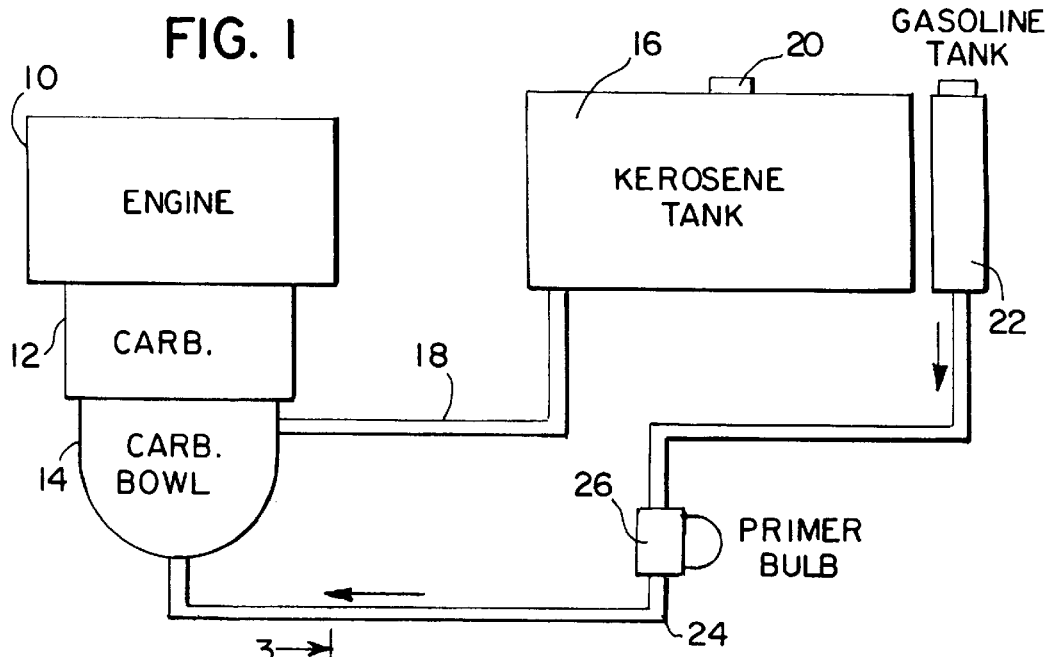
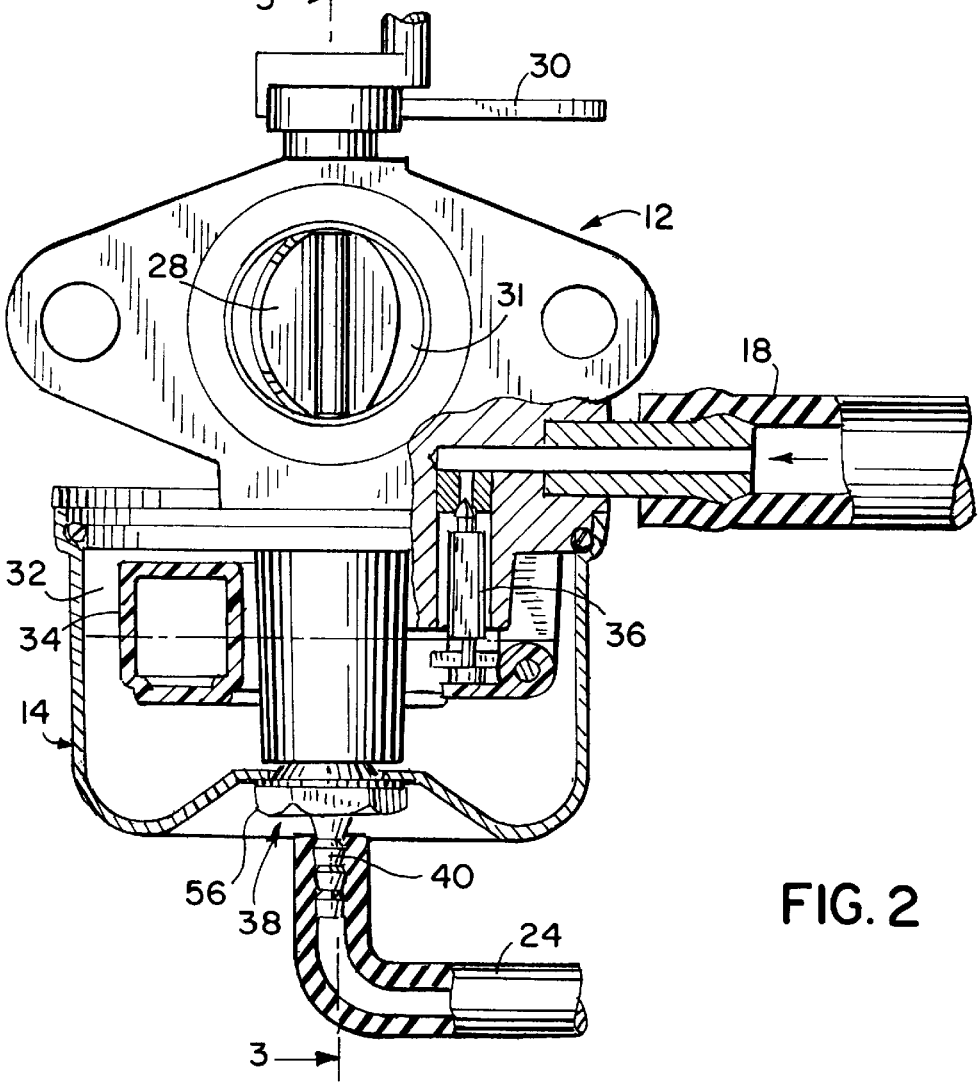
FIG. 2

PRIMING SYSTEM FOR INTERNAL COMBUSTION ENGINES

BACKGROUND OF THE INVENTION

This invention relates to priming systems for an internal combustion engine. More particularly, this invention relates to such priming systems for engines running on a relatively heavy fuel, and using a relatively lighter fuel for priming.

Priming systems are known for gasoline powered internal combustion engines. These priming systems typically deliver a small amount of raw gasoline into the carburetor throat, to increase the startability of the engine during cold starting.

In many countries, the engines operate on a heavier fuel than gasoline, such as kerosene, JP8 or diesel fuel. These heavier fuels are less volatile, and consequently it is difficult to start an engine that operates on a heavier fuel, particularly when the engine is cold.

To overcome this problem, it is known to use a lighter fuel such as gasoline as a priming fuel, and then change over to the heavier fuel during engine operation. Such prior art priming systems typically include relatively expensive electrically operated solenoid valves or special carburetors having two float bowls, or a partitioned float bowl with two chambers, to accommodate the two fuels. Thus, these prior art priming systems are typically expensive to manufacture and assemble.

To increase the startability of such dual fuel engines, it is known to manually drain the carburetor fuel bowl of the heavier fuel before engine starting. Some prior art priming systems have a valve that is manually operated to drain the fuel into a container or, more commonly, to drain the fuel directly on the ground. The disadvantages of these prior art priming systems is that they require several steps to operate, the drained fuel is often wasted, and the drained fuel may be left to evaporate into the atmosphere.

SUMMARY OF THE INVENTION

A priming system for an internal combustion engine is disclosed that is particularly suitable for use on engines burning a relatively heavy fuel such as kerosene, JP8 or diesel fuel, which are primed using a relatively lighter fuel such as gasoline. JP8 is a fuel typically used by the military that is similar to diesel fuel. The priming system is less expensive than prior art priming systems, and is easier to operate. Also, the priming system conserves fuel when compared to prior art priming systems.

In its broadest form, the priming system includes a primary fuel chamber or fuel tank that stores a primary fuel, and a secondary fuel chamber or secondary fuel tank that stores a secondary fuel. The priming system also includes a carburetor having a fuel bowl, a fuel nozzle in fluid flow communication with the fuel bowl, a primary fuel passageway that provides fluid flow communication between the primary fuel chamber and the fuel bowl, and a secondary fuel passageway that provides fluid flow communication between the secondary fuel chamber on the one hand and at least one of the fuel bowl, the fuel nozzle and the carburetor venturi on the other hand.

An additional important feature of the priming system is a manually-actuable primer that is connected in fluid flow communication with at least one of the primary fuel passageway and the secondary fuel passageway. The actuation of the manually-actuable primer creates a pressure that either transfers fuel from the fuel bowl to the primary fuel storage chamber, or creates a pressure to transfer fuel from the secondary fuel chamber to the carburetor. When fuel is transferred from the fuel bowl to the primary fuel storage chamber, the fuel is reused and is not wasted as in the prior art.

In one embodiment of the present invention, the actuation of the manually-actuable primer draws priming fuel from the secondary fuel chamber into at least one of the fuel bowl and the fuel nozzle. The secondary fuel mixes with the primary fuel in the fuel bowl to increase startability, without the need to drain the fuel bowl. Some of the secondary fuel may also be provided to the fuel nozzle through a special adapter having a plurality of first apertures in fluid flow communication with the fuel bowl, and having at least one second aperture in fluid flow communication with the nozzle. As a result, some of the secondary fuel is provided by the fuel nozzle directly to the carburetor venturi upon the initial starting attempt of the engine, further increasing the startability of the engine.

In an alternate embodiment, some of the secondary fuel may be provided directly to the venturi via a venturi feed passageway that is in fluid flow communication between the secondary fuel passageway and the venturi. In this embodiment, a restrictor is disposed in either the secondary fuel passageway or the venturi feed passageway so that only about 5 to 20 percent of the secondary fuel is provided to the venturi, whereas 80 to 95 percent of the secondary fuel is provided to the fuel bowl.

In another embodiment of the present invention, the manually-actuable primer is used to draw secondary fuel from the carburetor fuel bowl and return it to the secondary fuel chamber before engine starting. Thereafter, a changeover valve is operated to allow the secondary fuel to be gravity-fed to the fuel bowl for engine starting. After the engine has started, the changeover valve is again operated to permit the primary fuel to be gravity-fed from the primary fuel chamber to the carburetor fuel bowl during engine operation.

BRIEF DESCRIPTION OF THE DRAWINGS

FIG. 1 is a schematic diagram of a first embodiment of the present invention.

FIG. 2 is an end view of a carburetor used with the first embodiment, with the carburetor fuel bowl being shown in partial section.

DETAILED DESCRIPTION OF THE INVENTION

Figure 3:
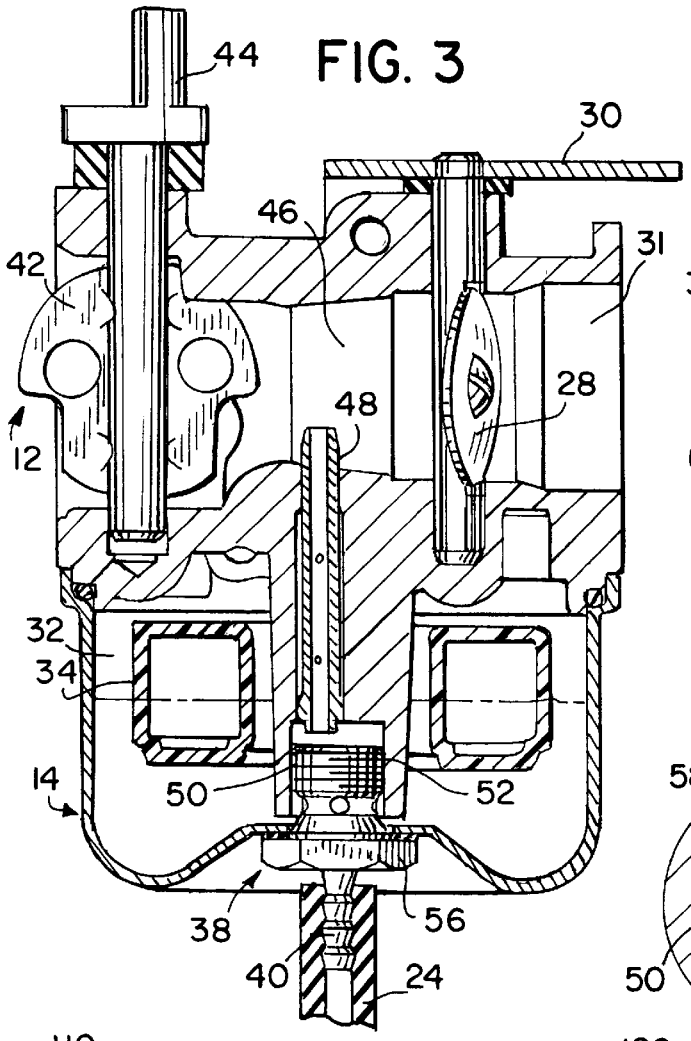
FIG. 3 is a side cross-sectional view of the carburetor according to the first embodiment.

FIG. 1 is a schematic view of a first embodiment according to the present invention. In FIG. 1, an engine 10 has a float feed carburetor 12 with a float-type fuel bowl 14. A primary fuel chamber or tank 16 is in fluid flow communication with the carburetor bowl via a primary fuel passageway 18. Tank 16 has a fuel fill cap 20. A secondary fuel chamber or tank 22 provides a secondary fuel to carburetor bowl 14 via a secondary fuel passageway 24. A manually-actuable primer 26 is in fluid flow communication with both secondary fuel chamber 22 and bowl 14. The actuation of primer 26 pumps fuel from chamber 22 to carburetor bowl 14 by creating a pressure. Both primary fuel chamber 16 and secondary fuel chamber 22 are preferably disposed at an elevation higher than carburetor bowl 14 to assist in a gravity feed of the respective fuels from the tanks.

The operation of the embodiment in FIG. 1 is as follows. Before the engine is started, approximately 7 cubic centimeters of fuel (for a relatively small, single cylinder internal combustion engine) is pumped from the secondary fuel chamber 22 to carburetor bowl 14 by actuating primer 26 one or more times. For example, if the primer bulb has a capacity of 1.4 cc, then primer 26 should be actuated five times to pump 7 cc of the lighter, secondary starting fuel into carburetor bowl 14. The secondary fuel mixes with approximately 21cc of the heavier fuel, kerosene, JP8 or diesel, that is typically present in the carburetor bowl from the last operation of the engine. Thus, the ratio of primary fuel to secondary fuel is approximately 3:1, although other ratios such as 2:1 may be used. The engine is then started in the normal manner. The higher volatility of the secondary fuel will result in a more volatile fuel mixture in the fuel bowl, thereby increases startability of a cold engine. Also, as described below, some of the secondary fuel may be provided directly to the fuel nozzle and, thus, to the carburetor venturi, further increasing the startability of the engine.

FIG. 2 is an end view of a carburetor according to the first embodiment, with the float bowl shown in partial cross section. In FIG. 2, carburetor 12 includes a throttle valve 28 that is actuated by a throttle control lever 30. Throttle valve 28 is disposed in a carburetor throat 31, that includes a venturi.

The carburetor also includes a float-type fuel bowl 14 having a reservoir 32 therein. The amount of fuel in the reservoir is controlled by a float 34 in combination with a metering valve 36, as is well known in the art. Metering valve 36 controls the amount of primary fuel entering the reservoir 32 via a primary fuel passageway 18.

Carburetor 12 is a standard carburetor that does not require special modification, except for the use of the adapter discussed below. Carburetor 12 should be a carburetor suitable for use of a heavier fuel such as kerosene, JP8 or diesel. If kerosene is the primary fuel, the main fuel jet has a somewhat larger diameter to accommodate the heavier fuel. For example, in a Briggs & Stratton Model 9 engine, the main fuel jet diameter for a gasoline engine would be about 0.027 inches, whereas the diameter of the main fuel jet for a kerosene engine carburetor would be about 0.031 inches. For a somewhat larger Briggs & Stratton Model 13 engine, the values would be 0.032 and 0.034 inches for a gasoline and kerosene fuel jet, respectively.

Referring again to FIG. 2, the carburetor according to the present invention also includes a special adapter 38 that is used in place of the typical carburetor fuel bowl nut. Adapter 38 includes a fitting 40 that receives an end of secondary fuel passageway 24.

Figure 4:
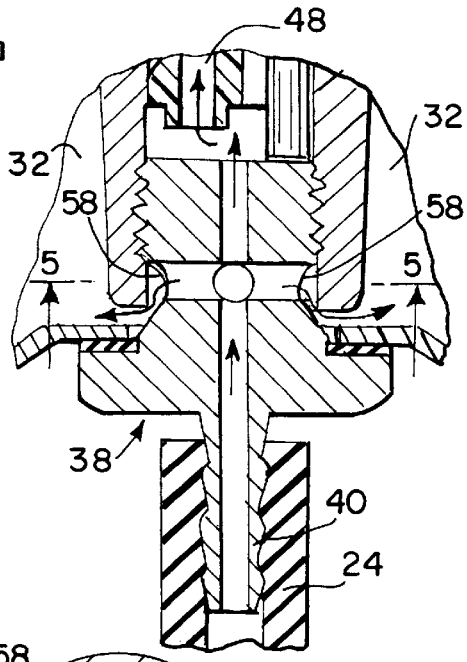
FIG. 4 is an exploded cross-sectional view of the carburetor adapter and nozzle assembly.
Figure 5:
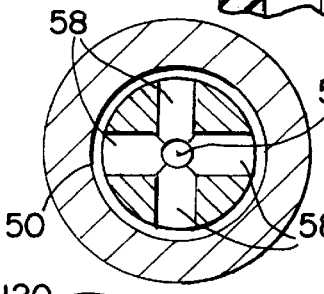
FIG. 5 is a cross-sectional end view of the adapter and integrally-formed fuel jet, taken along line 5—5 of FIG. 4.

FIGS. 3 through 5 are additional views of the carburetor of FIG. 2. In FIGS. 3 through 5, carburetor 12 may also include a choke valve 42 that is operated by a choke control lever 44 to further increase startability by reducing the intake air flow during engine starting. The carburetor also includes a venturi 46, which is provided with fuel by a main fuel nozzle 48.

As described above, the present invention includes a special adapter 38 that is received in the bowl nut aperture 50. Adapter 38 includes an integrally-formed fuel jet 52 that provides fuel to nozzle 48 via an aperture 54 (FIG. 5). Adapter 38 also includes an integrally-formed bowl nut 56, and a plurality of apertures 58. Apertures 58 provide secondary fuel from passageway 24 to fuel bowl reservoir 32, and are calibrated to allow between about 80 to 90 percent of the fuel received by passageway 24 to the fuel bowl reservoir. The remainder of the secondary fuel is provided to jet 54 and then to fuel nozzle 48.

In a typical float feed carburetor for a gasoline-powered Briggs & Stratton Model 9 engine, there are two apertures which provide communication between a primary fuel feed passageway and the float bowl, each having a diameter of about 0.055 inches. For a kerosene carburetor according to the first embodiment, there are four apertures 58, each having a diameter of about 0.090 inches. This arrangement permits about 80 to 90 percent of the fuel entering adapter 38 to be dispersed into the bottom of the float bowl, with the remainder being directed to fuel nozzle 48. In this embodiment, fitting 40 has an outer diameter of about 0.125 inches, and an inner diameter of about 0.062 inches.

There are no other special modifications that need to be made to the carburetor according to the first embodiment except for the adapter 38 discussed above. However, the carburetor float bowl reservoir 32 should have sufficient space above float 34 when the float bowl if full of primary fuel to accommodate additional secondary fuel through priming.

FIGS. 6 through 9 relate to a second embodiment of the present invention. The second embodiment is similar to the first embodiment discussed above except that in the second embodiment a portion of the secondary fuel is provided directly to the carburetor venturi, instead of to the fuel nozzle as in the first embodiment.

Figure 6:
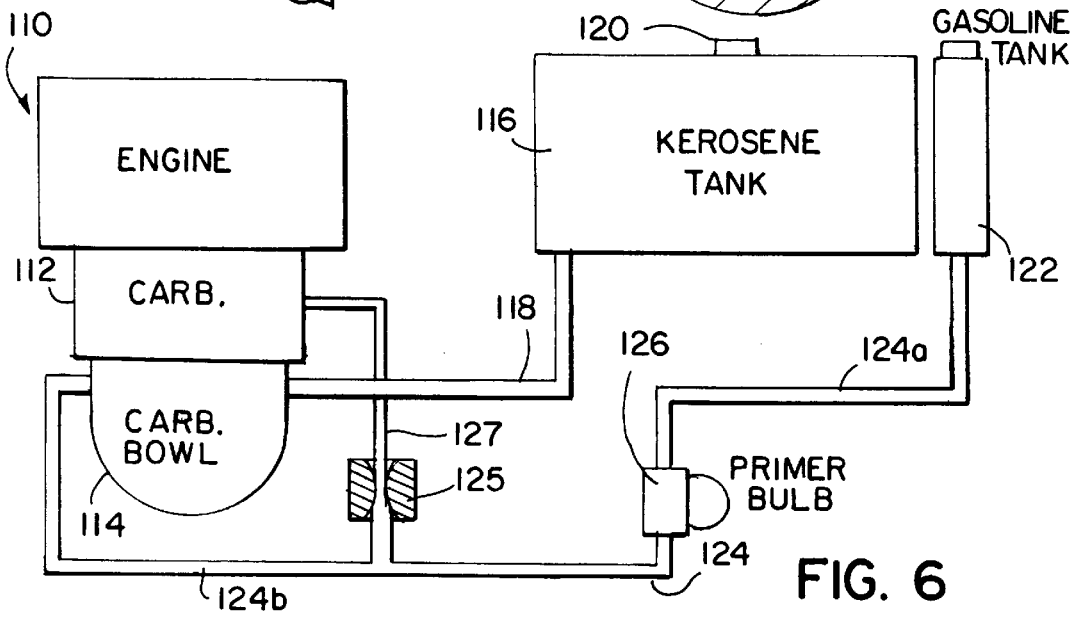
FIG. 6 is a schematic diagram of a second embodiment of the present invention.

Referring to FIG. 6, engine 110 includes a carburetor 112 having a carburetor bowl 114. A primary fuel chamber 116 stores the primary fuel, which is provided to carburetor bowl 114 via a primary fuel passageway 118. Primary fuel may be added to chamber 116 via a fuel cap 120. The second embodiment also includes a secondary fuel chamber 122 that provides secondary fuel to carburetor bowl 114 via a secondary fuel passageway 124. A portion of the secondary fuel is also provided to a carburetor venturi (FIGS. 8 and 9) through a restrictor 125 via a venturi feed passageway 127. A manually-actuable primer 126 is provided in fluid flow communication between secondary fuel tank 122 and secondary fuel passageway 124. Primary fuel chamber 116 and secondary fuel chamber 122 may be separate tanks, or may be formed from a single tank having a partition that creates the two distinct chambers.

Operation of the embodiment of FIGS. 6 through 9 is as follows. When the engine is to be started, primer 126 is manually operated one or more times to create a pressure during each operation that provides fuel from secondary chamber 122 to carburetor bowl 114. At the same time, a smaller portion of the secondary fuel is provided to the carburetor venturi through the restrictor 125 and venturi feed passageway 127. As a result, a secondary fuel mixes with the primary fuel in the float bowl, thereby increasing its volatility and also increasing the startability of the engine. At the same time, additional pure secondary fuel is provided directly to the carburetor and venturi to increase startability. After the engine has started, primary fuel chamber 116 provides fuel via passageway 118 to carburetor bowl 114 by gravity feed.

Figure 7:
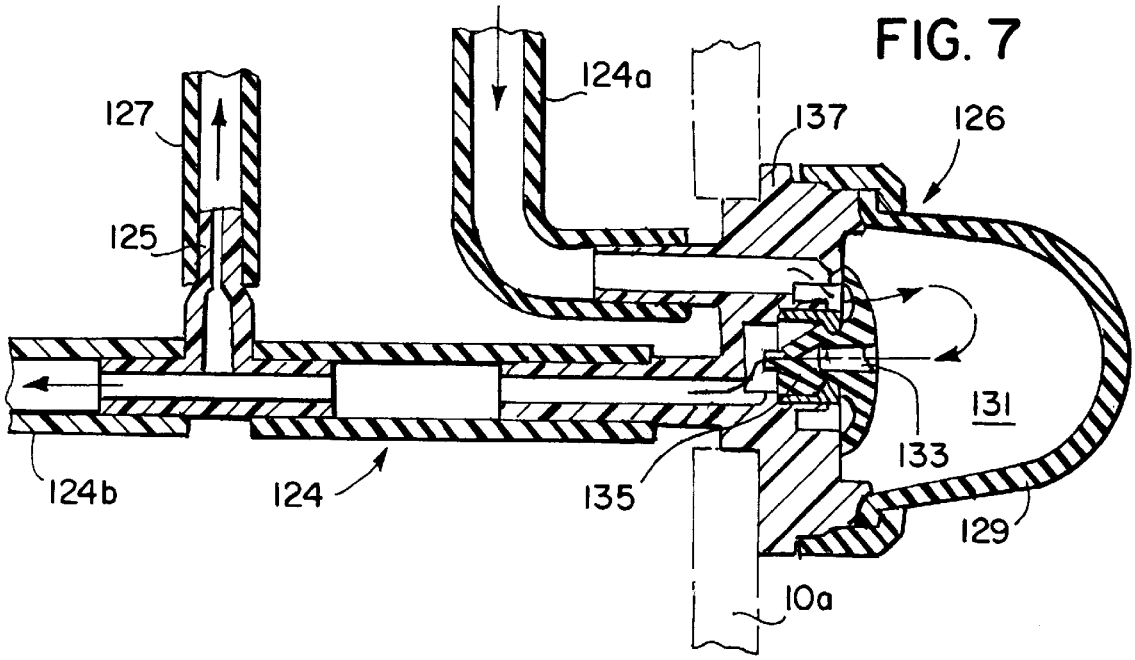
FIG. 7 is an exploded cross-sectional view of a primer bulb assembly used with the second embodiment.

FIG. 7 is a cross-sectional side view of a primer assembly that may be used with the second embodiment. In FIG. 7, primer 126 includes a resilient primer bulb 129 that is depressed by the operator to prime the engine. Bulb 129 includes a chamber 131 therein that receives fuel from secondary fuel chamber 122 (FIG. 6) via an upper portion 124*a* of secondary fuel feed passageway 124. When bulb 129 is depressed, fuel in chamber 131 is forced through an umbrella valve opening 133 to thereby open a duckbill valve 135. As a result, fuel is transferred via a lower portion 124*b* of secondary fuel passageway 124 to carburetor bowl 114 (FIG. 6). A relatively small portion of the secondary fuel is provided through a restrictor 125 to venturi feed passageway 127, and thereafter to the carburetor venturi as described above. The restrictor is sized such that approximately 5 to 20 percent of the secondary fuel is provided to the venturi via the venturi feed passageway, and the remaining 80 to 95 percent of the secondary fuel is provided to the carburetor fuel bowl.

The primer assembly 126 is affixed to a support 137, which in turn is attached to a plate 10*a* of engine 10 (FIG. 6). Although primer 126 is depicted and described in connection with FIG. 7, it will be apparent to those skilled in the art that a similar primer assembly may be used with the other embodiments of the invention. For larger engines, it may be desirable to increase the size of primer bulb 129 so that a larger volume of priming, secondary fuel may be provided to the engine with each operation of the primer.

Figure 8:
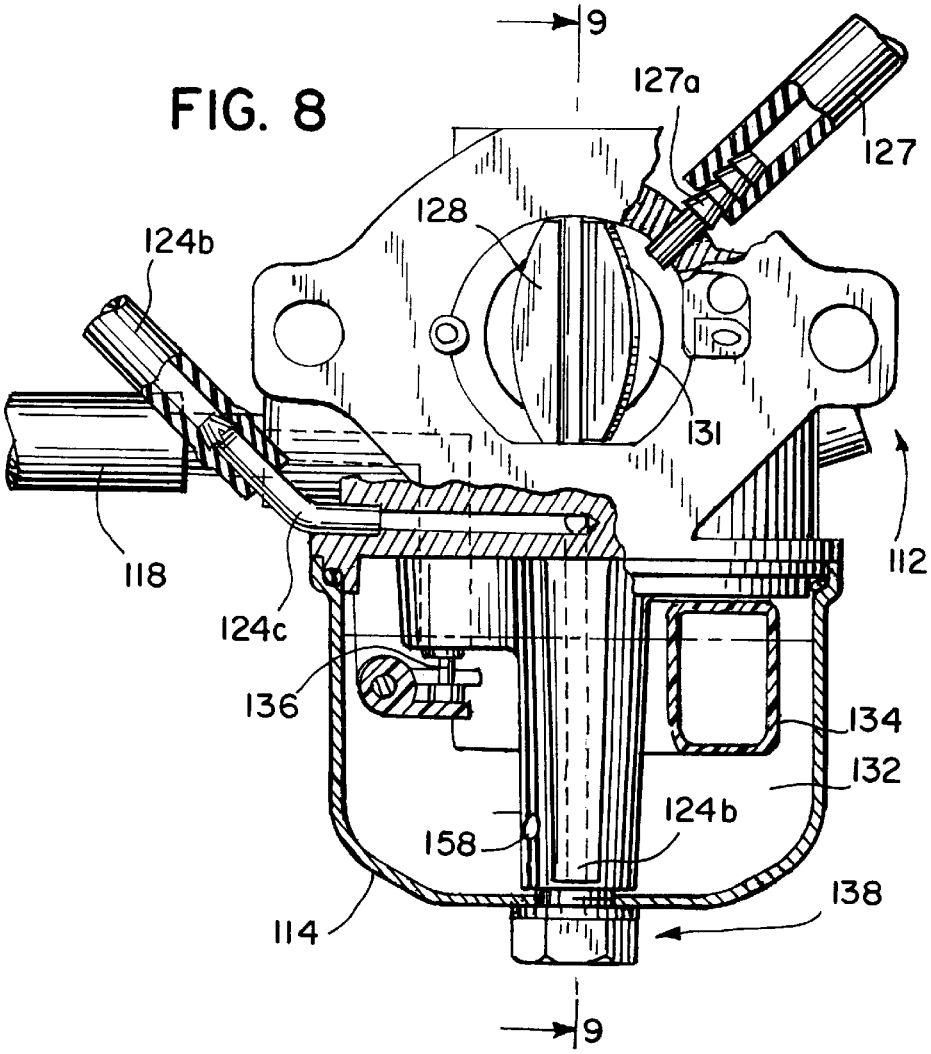
FIG. 8 is an end view of a carburetor according to the second embodiment, shown in partial section.
Figure 9:
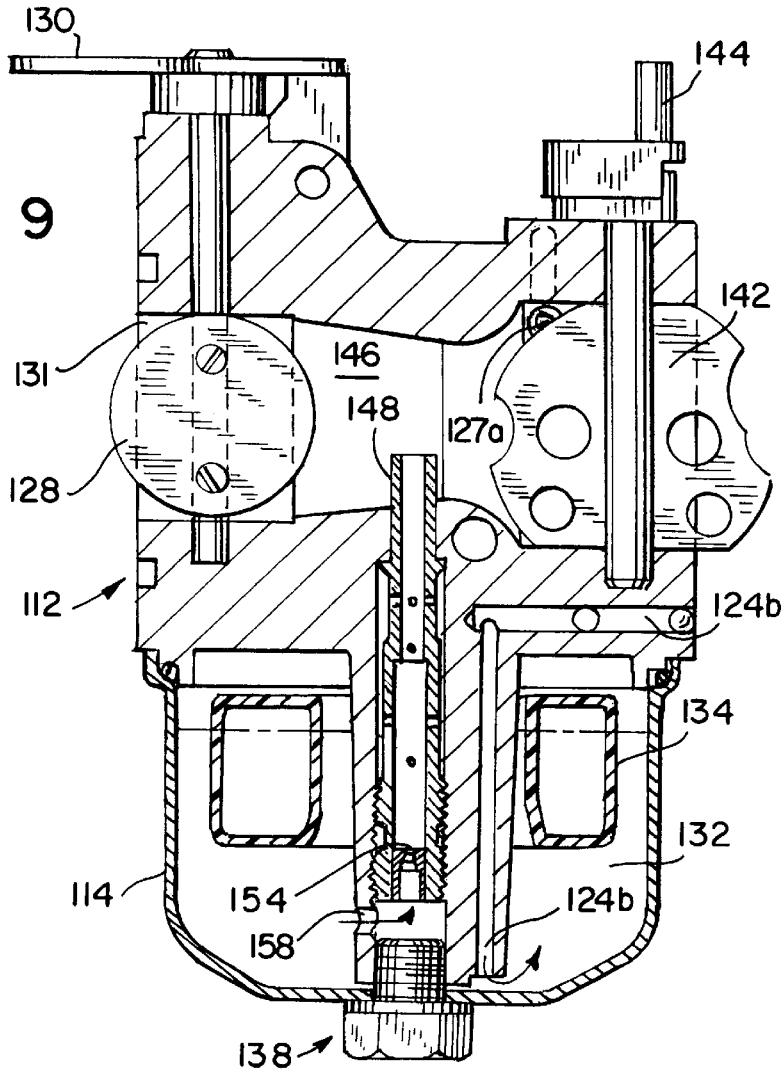
FIG. 9 is a side cross-sectional view of a carburetor according to the second embodiment.

FIGS. 8 and 9 depict a carburetor that may be used with the second embodiment. In FIGS. 8 and 9, carburetor 112 includes a float-type fuel bowl 114 having a float 134 and a metering valve 136 therein. Float bowl 114 defines a fuel reservoir 132. Reservoir 132 communicates with a main fuel nozzle 148 (FIG. 9) via one or more apertures 158 and a jet 154 (FIG. 9). Fuel bowl 114 is retained by a fuel bowl nut 138.

The primary fuel is fed to the fuel bowl via a primary fuel feed passageway 118, which terminates near an upper portion of fuel bowl 114. The secondary fuel is provided to the fuel bowl via a passageway 124*b*, which terminates near a lower portion of the fuel bowl. The carburetor is modified to include a fitting 124*c* that is part of the secondary fuel flow passageway.

Carburetor 112 also includes a throttle valve 128 that is disposed in a carburetor throat 131. As best shown in FIG. 9, the throat includes a venturi 146. The carburetor may also include a choke valve 142, operated by a valve control lever 144, that reduces the intake air flow to throat 131 during engine starting.

A shot of raw secondary fuel is provided directly to venturi 146 via secondary fuel passageway 127 and a fitting 127*a* whose outlet is near the upstream end of venturi 146 (FIG. 9). As a result, raw secondary fuel is provided directly to the venturi by operation of the priming system according to the second embodiment, while the majority of the secondary fuel is mixed with the primary fuel in the float bowl. When the engine is started, the secondary fuel in the venturi is provided with the rich air/fuel mixture directly to the combustion chamber, along with a mixture of the primary fuel and secondary fuel from the fuel bowl.

Figure 10:
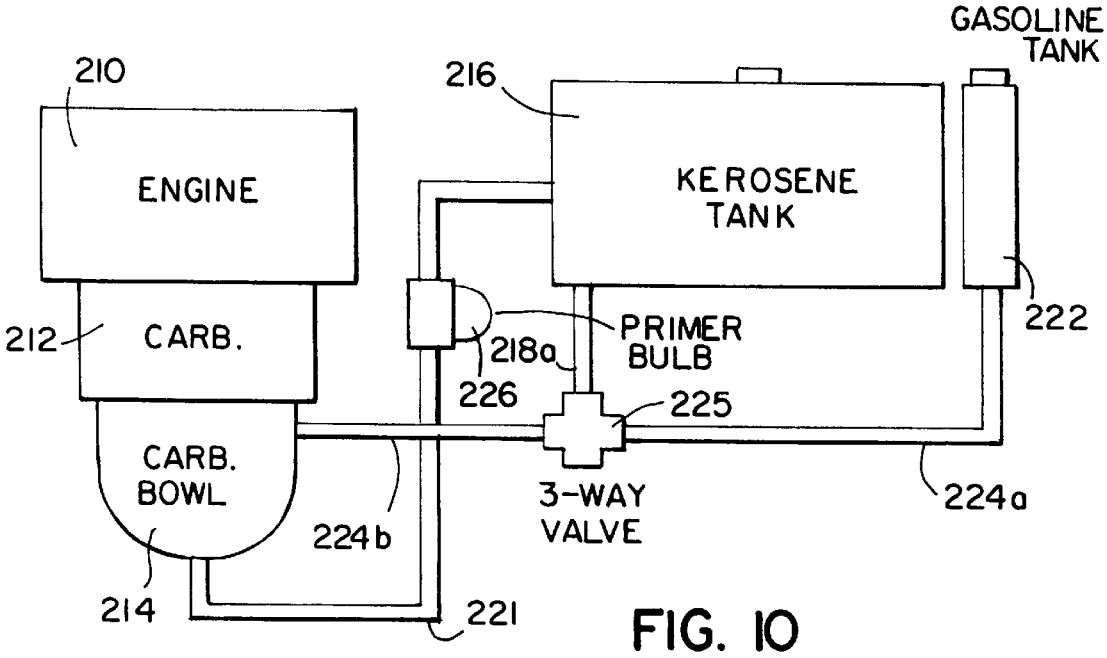
FIG. 10 is a schematic diagram of a third embodiment according to the present invention.

FIG. 10 is a schematic diagram of a third embodiment of the present invention. The embodiment of FIG. 10 differs from the first and second embodiments in that substantially all of the primary fuel from the carburetor bowl is removed from the carburetor bowl in response to operation of the primer, and returned to the primary fuel tank. Thereafter, secondary fuel is provided to the carburetor bowl through a changeover valve for engine starting.

In FIG. 10, engine 210 includes a carburetor 212 having a carburetor fuel bowl 214. A primary fuel storage chamber 216 provides primary fuel via primary fuel passageways 218*a*,218*b* through a three-way changeover valve 225. A secondary fuel chamber 222 provides secondary fuel for engine starting through passageways 224*a*,224*b* and through changeover valve 225. A manually-actuable primer 226 is disposed on passageway 221 in fluid communication between primary fuel storage chamber 216 and carburetor bowl 214. Primer 226 may be similar to the primers discussed in connection with the first and second embodiments.

The third embodiment is operated in the following manner. After the engine has been stopped, some of the primary fuel (kerosene, JP8, diesel or the like) remains in carburetor bowl 214. Before the engine is started again, primer 226 is actuated to create a pressure that draws primary fuel from bowl 214 and returns the primary fuel to primary fuel storage chamber 216. During this operation, changeover valve 225 is set in the "off" position. After engine priming, the changeover valve is set to the "secondary fuel" or "starting" position. In this position, secondary fuel from secondary fuel chamber 222 is provided via passageways 224*a* and 224*b* to carburetor bowl 214. Thus, substantially pure secondary fuel is provided to the carburetor bowl for engine starting. After the engine has started, changeover valve 225 is set to the "primary fuel" or "run" position, thereby allowing primary fuel from primary fuel storage chamber 216 to be provided to carburetor bowl 214 via passageways 218*a* and 218*b*.

While several embodiments of the present invention have been shown and described, alternate embodiments will be apparent to those skilled in the art and are within the intended scope of the present invention. Therefore, the invention is to be limited only by the following claims.

What is claimed is:

1. A priming system for an internal combustion engine, comprising:

a primary fuel chamber that stores a primary fuel;

a secondary fuel chamber that stores a secondary fuel;

a carburetor, including a fuel bowl;

a fuel nozzle in fluid flow communication with said fuel bowl;

a primary fuel passageway between said primary fuel chamber and said fuel bowl that provides primary fuel from said primary fuel chamber to said fuel bowl;

a secondary fuel passageway between said secondary fuel chamber on the one hand and at least one of said fuel bowl and said fuel nozzle on the other hand, wherein there is no fuel changeover valve or drain valve in fluid flow communication with either of said fuel passageways; and a manually-actuable primer, wherein actuation of the primer creates a pressure to transfer fuel from said secondary fuel chamber through said secondary fuel passageway to at least one of said fuel bowl and said fuel nozzle.

2. The priming system of claim 1, wherein said primary fuel chamber includes a primary fuel tank, and wherein said secondary fuel chamber includes a separate secondary fuel tank.

3. The priming system of claim 1, further comprising:

a single fuel tank having said primary fuel chamber and having said secondary fuel chamber.

4. The priming system of claim 1, wherein said primary fuel chamber and said secondary fuel chamber are disposed at a higher position than said fuel bowl when said engine is in a normal operating position.

5. The priming system of claim 1, wherein said secondary fuel passageway includes:

an adapter, disposed at least partially within said carburetor adjacent said fuel bowl, having a plurality of first apertures in fluid flow communication with said fuel bowl, and having a second aperture in fluid flow communication with said fuel nozzle.

6. The priming system of claim 5, wherein said adapter is formed integral as one piece with a fuel jet.

7. The priming system of claim 1, wherein said primer further comprises:

a valve that is opened when said primer is actuated.

8. The priming system of claim 1, wherein said fuel bowl is a carburetor float bowl.

9. The priming system of claim 1, wherein said fuel bowl has only a single chamber that holds fuel.

10. The priming system of claim 1, wherein said primary fuel passageway is interconnected with an upper portion of said fuel bowl, and wherein said secondary fuel passageway is interconnected with a lower portion of said fuel bowl.

11. The primary system of claim 1, wherein said secondary fuel passageway extends between said secondary fuel chamber on the one hand and both said fuel bowl and said fuel bowl and said fuel nozzle on the other hand.

* * * * *